United States Patent [19]

Liedberg

[11] 4,420,511

[45] Dec. 13, 1983

[54] METHOD FOR COATING AN OBJECT

[75] Inventor: Kurt H. Liedberg, Skara, Sweden

[73] Assignee: Atlas Copco Aktiebolag, Nacka, Sweden

[21] Appl. No.: 48,014

[22] Filed: Jun. 13, 1979

[30] Foreign Application Priority Data

Jun. 13, 1978 [SE] Sweden ..... 7806810

[51] Int. Cl.[3] ..... B05D 7/22

[52] U.S. Cl. ..... 427/236; 427/239; 427/346; 427/424

[58] Field of Search ..... 427/346, 236, 233, 234, 427/239, 421, 424

[56] References Cited

U.S. PATENT DOCUMENTS

| | | | |
|---|---|---|---|
| Re. 24,187 | 7/1956 | Burwell | 427/234 |
| 3,227,575 | 1/1966 | Ziebart | 427/239 |
| 3,513,016 | 5/1970 | Wood et al. | 427/239 |
| 3,632,409 | 1/1974 | Barnett | 427/346 |
| 4,025,664 | 5/1977 | Gerek et al. | 427/346 |

FOREIGN PATENT DOCUMENTS

| | | | |
|---|---|---|---|
| 496966 | 10/1953 | Canada | 427/234 |
| 2411881 | 9/1975 | Fed. Rep. of Germany | 427/234 |

*Primary Examiner*—Sadie L. Childs

*Attorney, Agent, or Firm*—Frishauf, Holtz, Goodman & Woodward

[57] ABSTRACT

A novel method for coating an object with a thixotropic material, comprising application of the material on the object to be coated and exposing the object and thereby the thixotropic material applied thereon to vibrational or repeated impact forces so as to temporarily liquidize the coating material. By the disclosed method it is possible to obtain an improved thixotropic material coverage of an object, particularly as regards narrow, difficult-to-reach areas such as gaps and crevices of closed cavities. A suitable field of use for this method is anti-corrosion treatment of car bodies.

5 Claims, No Drawings

METHOD FOR COATING AN OBJECT

This invention relates to a method for coating an object with a thixotropic material.

A problem concerned with surface coating with thixotropic materials, like paint, rust protectives etc. is to make the coating material flow out effectively over the object and to penetrate into narrow gaps or crevices therein. Such crevices usually exist between joined parts, for instance between spot welded parts of a car body.

A thixotropic material is characterized by its molecular structure which normally makes the mateial very viscous or gel like, but which under influence of a pressure caused for instance by vibrations or repeated impacts temporarily collapses and give the material a liquid character. This occurs when the material is exposed to agitation during brush appliation or when it is forced through a flow restricting aperture such as a spray nozzle. As soon as the pressure upon the molecule is interrupted however, the material becomes viscous again.

In some cases these characteristics are disadvantageous, because immediately after having been applied on a surface, the coating material regains its gel like character and does not spread out to a larger area than what it was originally distributed over. This is a problem particularly when applying a thixoscopic material on objects having such a shape that it is difficult to reach every part of it directly.

The main object of the present invention is to create a novel method for obtaining an improved coverage of an object when coated with a thixotropic material.

Another object of the invention is to create a method by which the invisible inside walls of a hollow body may be completely covered with a thixotropic coating material.

According to the present invention the above objects are obtained by the steps of applying a thixotropic coating material onto the object to be coated and exposing the object to vibrational or repeated impact forces, so as to temporarily make the coating material liquid. The coating material is thereby effectively distributed over the surface of the object. As this activation sequence is ended, the coating material immediately resumes its gel like character, which means that the coating material remains stationary even on inclined or vertical surfaces.

The application of the coating material and the vibration or impact treatment may either be carried out in succeeding steps or simultaneously.

The method according to the present invention has an important field of use in anti-corrosion treatment of car bodies. Car bodies of today's cars incorporate a number of closed cavities which are coated with rust protectives by spraying via small diameter injection opening. Each cavity is defined by a number of pressed sheet steel parts which are joined by spot welding and, because of that, each cavity has a number of difficult-to-reach areas such as crevices or narrow gaps which are particularly exposed to rust action.

For avoiding the problems arising when using a liquid rust protective oil, namely flowing and dripping of surplus oil on the floor of the working premises resulting in an impaired working environment, a thixotropical material is preferred.

In order to effectively and quickly cover all the parts of a cavity in a car body, the coating material may be sprayed into the cavity by means of a nozzle which is specially designed to cover, in one shot, the main part of the cavity surfaces via one particular injection opening. Thereupon, a vibration or impact delivering tool is applied against the outside of the car body for a certain period of time, for instance a few seconds, so as to make the applied material flow out and penetrate into all the narrow areas of the cavity.

When the vibration sequence is finished, the anti-corrosive material resumes its viscous character and stays frozen on inclined as well as on vertical surfaces.

For exerting the vibrations or impacts on the coated object, any type of vibrator or impact mechanism may be used. The delivered power and working frequency may be varied within wide ranges, but have to be chosen in response to the size and mass of the object to be acted upon. Good results have been achieved by using on a car body a pneumatic chisel hammer working at 300 blows per minute.

The main advantage obtained by this method is the possibility of using a non-dripping, thixotropic coating material and still obtaining a complete coverage of the surface or surfaces to be coated, even in invisible crevices and narrow gaps formed between spot welded sheets.

I claim:

1. A method for coating at least one surface of an object with a liquid coating material having thixotropic properties comprising spraying said coating material on a major portion of said at least one surface to partially coat said at least one surface, applying mechanical vibrations or repeated impact forces to said at least one surface which is partially coated with said coating material to decrease the viscosity of said material coated on said major portion of said at least one surface so that said material flows over the uncoated portions of said at least one surface, and then stopping said application of mechanical vibrations or repeated impact forces to cause said coating material to gel and cease to flow.

2. The method of claim 1 wherein said at least one surface of said object which is being coated comprises the interior walls of a hollow body on which the coating material is applied by spraying through one or more injection openings in said hollow body, and wherein said mechanical vibrations or repeated impact forces are applied to the outside of said hollow body and wherein said hollow body transmits said mechanical vibrations or repeated impact forces to the said at least one surface.

3. The method of claim 1 or claim 2 wherein said mechanical vibrations or repeated impact forces are applied while said coating material is being applied.

4. The method of claim 1 or claim 2 wherein said mechanical vibrations or repeated impact forces are applied after said coating material has been applied to said at least one surface.

5. The method of claim 3 wherein said mechanical vibrations or repeated impact forces are also applied after said coating material has been applied to said at least one surface.

* * * * *